United States Patent [19]

Tamulis

[11] 4,224,589

[45] Sep. 23, 1980

[54] LOW ENERGY MAGNETIC ACTUATOR

[75] Inventor: John C. Tamulis, Binghamton, N.Y.

[73] Assignee: International Business Machines Corporation, Armonk, N.Y.

[21] Appl. No.: 974,298

[22] Filed: Dec. 29, 1978

[51] Int. Cl.[2] ..... H01F 7/10

[52] U.S. Cl. ..... 335/237; 101/93.29; 101/93.48; 335/229; 361/152

[58] Field of Search ..... 335/237, 236, 235, 234, 335/233, 232, 231, 230, 229; 101/93.04, 93.48, 93.29–93.34; 361/152

[56] References Cited

U.S. PATENT DOCUMENTS

| | | | |
|---|---|---|---|
| 3,146,381 | 8/1964 | Moreau | 335/237 |
| 4,020,433 | 4/1977 | Uchidoi et al. | 335/230 |

*Primary Examiner*—Harold Broome

*Attorney, Agent, or Firm*—Kenneth P. Johnson

[57] ABSTRACT

Magnetic actuator apparatus in which the armature is held in a restrained position on a magnetic core by magnetic flux whose density is cyclically varied in time, and the armature is selectively released by a bucking coil that is energized only when the armature retention flux is at low holding value. The flux source is a permanent magnet that is reciprocated or rotated to vary the armature retaining force.

6 Claims, 3 Drawing Figures

LOW ENERGY MAGNETIC ACTUATOR

This application contains subject matter related to that disclosed and claimed in an application for a United States patent entitled "Magnetic Actuator Using Modulated Flux" bearing Ser. No. 974,297 filed by E. F. Helinski on the date of this application and commonly assigned.

BACKGROUND OF THE INVENTION

This invention relates generally to electromagnetic actuators and more particularly to such actuators of a "no work" type in which the armature or actuator is restrained against a biasing force and selectively released to an extended position.

In certain applications such as serial printers, magnetic actuators are used to operate print hammers and employ bucking coils to oppose the hammer retention force and release or fire the hammer. In the known devices, the release current for the bucking coil is relatively substantial so that separate components are used to construct the current drivers for the coil. These components add a significant cost to the alternative of manufacturing the drivers as integrated circuits, as are most of the printer control circuits.

As printer technology is advanced, the hammer actuators are required to be capable of higher repetition rates which result in problems of dissipating the coil heat caused by the greater proportion of on time per unit of time. Efforts have been made to advance the technology be reducing hammer mass, using supplemental windings and reset devices for the actuators.

One method of varying the magnitude of the release current is discussed in the aforementioned Helinski patent application, Ser. No. 974,297 in which a permanent magnet serves as the center leg of the three-legged core to provide a pair of parallel flux paths with the actuator serving as a component in one path and a variable reluctance element forming a part of the second path. As the reluctance of the latter path varies, it affects the flux density of the first path and permits energization of the bucking coil at a time when the actuator holding force is less than maximum. This structure, however, has a disadvantage of having to also overcome the reverse magnetomotive force due to a flux undulation in the bucking coil. A further disadvantage is evident in the use of multiple core structures with a common magnet and bucking coil in that the core structures are influenced by the change in reluctance of adjacent cores and thereby the flux passing through the coil.

OBJECTS AND SUMMARY OF THE INVENTION

It is accordingly a primary object of this invention to provide magnetic actuator apparatus in which the actuator is retained against a bias force by a cyclically varying magnetic flux density and is released by a bucking coil when the bias flux density is at a low value passing through the coil.

Another object of this invention is to provide magnetic actuator apparatus employing a bucking coil in which the coil is placed in a magnetic loop so that the reverse magnetomotive force is in series and in phase in the magnetomotive force created by the current pulse at the time of releasing the actuator.

Still another object of this invention is to provide a magnetic actuator apparatus of the "no work" type in which a permanent magnet is movable with respect to a core structure to produce cyclically varying flux density at the point of actuator retention, and in which the timing of bucking coil energization is controlled to coincide with the time of low level flux density at the actuator and at the coil.

The foregoing objects are accomplished in accordance with the invention by providing a magnetic core structure having first and second pairs of poles with one pair serving to retain in a cocked position an oppositely biased actuator, and the other pair being adjacent a relatively movable permanent magnet which produces a cyclically varying flux density at the first pole pair that retains the actuator. The core number has a center leg on which is wound a bucking coil that is selectively energizable when the flux density is at a low level to further reduce the retention flux at the actuator and to allow it to move away from its pole faces. The permanent magnet may reciprocate or rotate to change the air gap, and hence, the reluctance between the magnet and core to produce the flux density changes at the pole faces retaining the actuator. The bucking coil is controlled to permit energization when the reluctance is approximately at its largest value to thereby insure energization of the coil at the minimum flux density.

BRIEF DESCRIPTION OF THE DRAWING

FIGS. *2a, 2b,* and *2c* are waveforms representing magnetic flux density, coil current and actuator displacement for the apparatus in FIG. 1.

DESCRIPTION OF PREFERRED EMBODIMENTS

Figure 1:
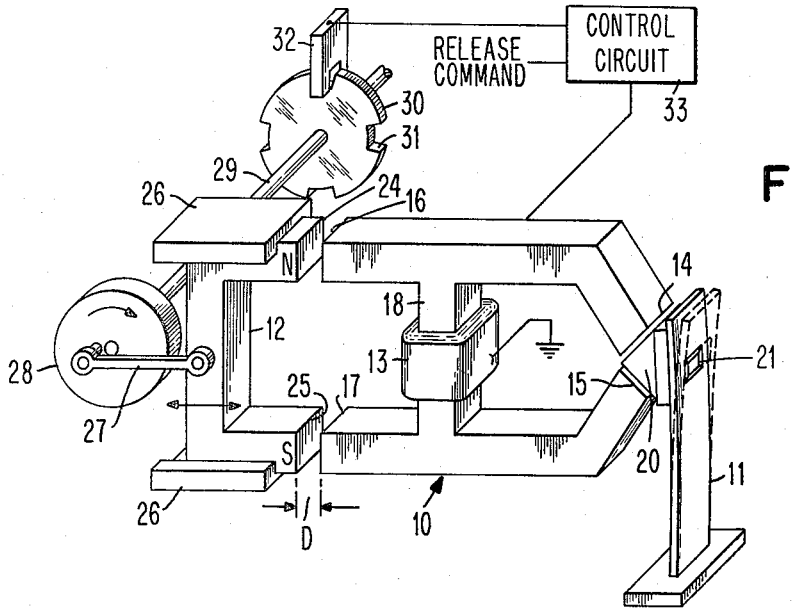
FIG. 1 is a schematic diagram of a magnetic actuator constructed in accordance with the principles of the invention.

Referring to FIG. 1, the magnetic actuator device according to the invention comprises generally a core member 10 and armature of actuator 11, and a reciprocable permanent magnet 12 and a bucking coil 13. The core member 10 is of a magnetically permeable material having a first pair of poles 14, 15; a second pair of poles 16 and 17, and a center leg 18. Actuator 11 is preferably of a magnetically permeable material such as spring steel, but need not be such. However, it must, of course, have a magnetically permeable block 20 attractable by pole faces 14 and 15. Actuator 11 is fixed at its lower end and either formed or located so that it is biased toward a free position indicated in phantom. The actuator is shown as carrying a print hammer 21 for impacting a marking element, not shown.

Permanent magnet 12 is U-shaped having a pair of pole faces 24, 25 mating with respective pole faces 16, 17 of the core member 10 and is guided for reciprocation with respect to core member in a pair of guide tracks 26. The permanent magnet may be moved by any suitable means and is shown in the figure as connected by a link 27 eccentrically secured to a rotating disk 28 on shaft 29 rotated by a motor, not shown, or other suitable means. The shaft also carries a slotted disk 30 having cutouts 31 which are sensed by any suitable means such as a photodetector 32. The photodetector serves to provide a gating signal at a control circuit 33 which is used in conjunction with a Release Command signal to energize bucking coil 13.

Figure 2:
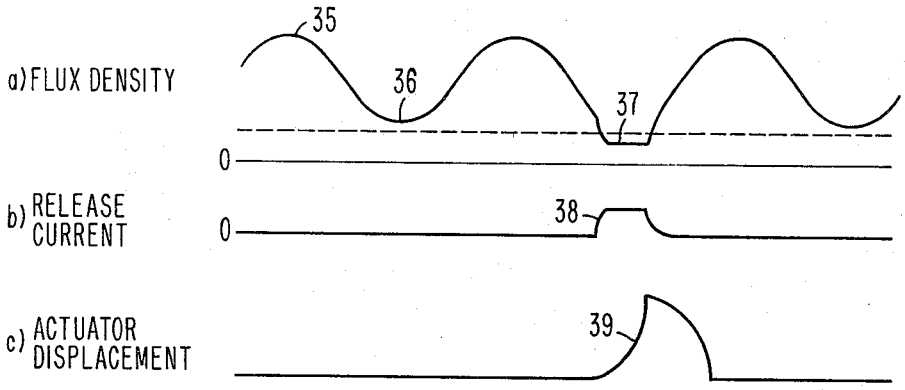

In operation, the rotation of shaft 29 and disk 28 result in the reciprocation of permanent magnet 12 relative to core member 10. The flux through core member 10 provides an attractive force for the actuator at pole faces 14, 15 holding the actuator in the position shown in solid lines. The limit of reciprocation or maximum width of gap "D" between the magnet and core is determined by the density of magnetic flux required to retain the actuator in its captured position, as shown. For example, the maximum gap is that required to retain the actuator in the position indicated by solid lines. Minimum gap is optionally that required to attract the actuator from a free standing position. As the permanent magnet reciprocates, the flux density, both through the first pole pair and the middle leg, will vary cyclically between a first high value 35 and a second lower value 36 as shown in the undulations in idealized waveform (a) in FIG. 2.

When release of the actuator is desired, a Release Command is provided at control circuit 33 to energize bucking coil 18. This command is controlled to be effective in coincidence with the time when the flux at the actuator pole faces and at the coil is at a low level. This coincidence is determined by the position of the timing disk cutouts 31 and photodetector 32. At that time, minimum current will be required through bucking coil 18 to effect actuator release. Assume the direction of flux to be from the designated north pole of the permanent magnet through the core middle leg 18, and through the parallel path of pole 14, block 20, and opposite pole 15 returning to the south pole of the permanent magnet.

The bucking coil is arranged to produce additional flux, when energized, to continue in the same direction as that produced by the permanent magnet through the middle leg; however, the newly created flux will form two paths, one being through the south and north poles of the permanent magnet and return, while most of the supplemental flux will be in the reverse direction from the original flux through the first pair of poles 14, 15 at the actuator. This produces a bucking flux in that leg to thereby reduce the retention flux sufficiently at point 37, waveform (a) in FIG. 2, so that actuator 11 will move out to the position shown in phantom.

It will be seen that the current energization of the coil shown by waveform (a) at 38 is optimally controlled to coincide with minimum or low flux density through the retention poles 14, 15. This action will require the least bucking current to achieve operation of the actuator. The motion of the actuator from its restrained position is shown in waveform (c) at 39. Current through the bucking coil is applied only briefly so that the magnetic flux through the permanent magnet will be able to exert an attracting force again on the actuator as it rebounds from impact at its extended or released position. Although the permanent magnet may be used to recapture the actuator, other devices such as a supplemental coil or mechanical reset device may be used to restore the actuator.

Figure 3:
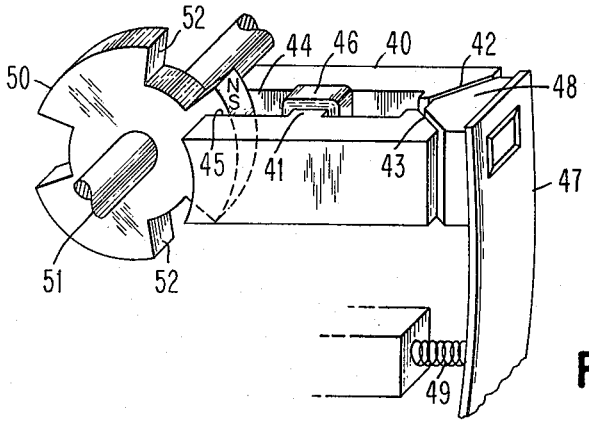
FIG. 3 is a schematic diagram of a modification of the actuator shown in FIG. 1 in which a rotating magnet is used to produce the changes in flux density.

A modification of the magnetic actuator in accordance with the invention is shown in FIG. 3. This embodiment illustrates the use of a rotating permanent magnet to effect cyclic undulations of the flux density through a retained actuator. The core member 40 is shown in a different plane from that in FIG. 1, but is similar thereto having a center leg 41 and first pair of poles 42, 43 and second pair of poles 44, 45. A bucking coil 46 is again wound about the center leg. Actuator 47 has a magnetically permeable block 48 which is attracted across the first poles 42, 43 by a magnetic flux present therein against the bias of spring 49.

The energizing flux is produced by a permanent magnet 50 mounted on a rotatable shaft 51 which also carries a timing disk, not shown. The permanent magnet is relieved at cutouts 52, and during rotation will vary the density of magnetic flux through the core, pole faces, and thus through the core member at both middle leg and actuator retaining faces. Bucking coil 46 can be energized in conjunction with the timing disk arrangement as shown in FIG. 1 to obtain release of the actuator at the time of minimum flux density. This will enable the use of minimum current in the coil.

It will be apparent that further modifications can be made in the actuator structure such as alternate arrangements of providing relative movement between the magnet and core structure, or supplemental restoring windings. The various pole faces can be coated with a non-magnetic material to prevent sticking of the relatively movable components. Multiple magnets can also be used, particularly in the rotating magnet embodiment.

While the novel features of the present invention have been shown and described with reference to preferred embodiments thereof, it will be understood by those skilled in the art that the foregoing and other changes can be made in the form and details without departing from the spirit and scope of the invention.

Having thus described my invention, what I claim as new, and desire to secure by Letters Patent is:

1. Magnetic actuator apparatus comprising:

a magneticaly permeable core member having first and second pairs of poles;

an actuator of magnetically permeable material attractable across said first pair of poles and resiliently biased toward a released position;

a permanent magnet movable with respect to said second pair of poles for producing magnetic flux in a said core member varying in density between a first value and a second value lower than the first value, each being sufficient to hold said actuator attracted to said first pair of pole faces; and means selectively operable at the time said flux density is at said second value for reducing said density still further to release said actuator.

2. Apparatus as described in claim 1 wherein said selectively operable means further includes a bucking coil and timing means for gating a release signal to said bucking coil while said flux density is at said minimum value.

3. Apparatus as described in claim 2 wherein said core member has a magnetically permeable leg intermediate said pole pairs and said bucking coil is disposed thereabout.

4. Apparatus as described in claim 1 wherein said permanent magnet is cyclically reciprocated with respect to said second pair of pole faces to vary the gap therebetween.

5. Apparatus as described in claim 1 wherein said permanent magnet is rotatable between said second pair of pole faces for varying the density of flux therein.

6. Apparatus as described in claim 1 wherein said flux density at said first value at said first pole pair is sufficient to attract said actuator thereto from said released position.

* * * * *